US006349853B1

(12) United States Patent
Grampassi

(10) Patent No.: US 6,349,853 B1
(45) Date of Patent: Feb. 26, 2002

(54) HYGIENIC BEVERAGE MACHINE

(75) Inventor: Massimo Grampassi, Castelvetro (IT)

(73) Assignee: S.P.M. Catering S.R.L., Spilamberto (IT)

( * ) Notice: Subject to any disclaimer, the term of this patent is extended or adjusted under 35 U.S.C. 154(b) by 0 days.

(21) Appl. No.: 09/668,132

(22) Filed: Sep. 22, 2000

(30) Foreign Application Priority Data

Sep. 28, 1999 (IT) ..... MO99A0206

(51) Int. Cl.[7] ..... B67D 5/06
(52) U.S. Cl. ..... 222/144.5; 222/146.6
(58) Field of Search ..... 62/70, 136, 342; 222/144.5, 146.6

(56) References Cited

U.S. PATENT DOCUMENTS

| | | | | |
|---|---|---|---|---|
| 2,559,032 A | * | 7/1951 | Tacchella | 62/136 |
| 3,256,100 A | * | 6/1966 | Berstein et al. | 62/136 |
| 3,359,748 A | * | 12/1967 | Booth | 222/144.5 |
| 3,528,587 A | | 9/1970 | Popinski | |
| 3,626,709 A | * | 12/1971 | Yuza | 62/136 |
| 3,642,174 A | | 2/1972 | Cornelius | |
| 3,643,835 A | | 2/1972 | Popinski | |
| 4,275,567 A | * | 6/1981 | Schwitters | 62/136 |
| 4,582,226 A | | 4/1986 | Doak | |
| 5,095,710 A | * | 3/1992 | Black et al. | 62/136 |
| 5,158,506 A | * | 10/1992 | Kusano et al. | 62/342 |
| 5,842,603 A | | 12/1998 | Romanyszyn et al. | |
| 6,058,721 A | * | 5/2000 | Midden et al. | 62/136 |

FOREIGN PATENT DOCUMENTS

| | | |
|---|---|---|
| DE | 31 48 859 | 8/1982 |
| GB | 2 287 306 | 9/1995 |
| WO | 97 12184 | 4/1997 |

* cited by examiner

*Primary Examiner*—Philippe Derakshani
*Assistant Examiner*—Thach H. Bui
(74) *Attorney, Agent, or Firm*—Wolf, Greenfield & Sacks, P.C.

(57) ABSTRACT

A highly hygienic machine for producing and dispensing still and carbonated crushed-ice or slush-type products comprises a base for accommodating conventional operating elements above which at least one tank for containing the slush-type products ready for consumption is installed; the tank is provided with a dispenser tap, is hermetic and can be hermetically connected to pressurization means and to pre-cooling elements for volumes of still or carbonated beverages.

16 Claims, 1 Drawing Sheet

HYGIENIC BEVERAGE MACHINE

BACKGROUND OF THE INVENTION

The present invention relates to a highly hygienic machine for making and dispensing still and carbonated crushed-ice or slush-type products.

Conventional machines making and dispensing slush-type products to consumers are well known and are usually installed in public concerns; they essentially consist of a box-like frame supporting and containing the elements adapted to prepare the slush-type product; a usually transparent tank, in which the prepared slush-type product is kept mixed and ready for consumption, is installed above this frame.

These transparent tanks suffer drawbacks, including the poor hygiene that they offer as a whole due to their constructive structure, which practically places in direct contact with the environment the tanks containing the product designed for consumption, and the necessity for long and troublesome operations for periodically cleaning the tanks, which entails stopping the machines completely.

These periodic cleaning operations must further be repeated frequently because conventional tanks tend to retain clearly visible marks of the levels reached each time by the slush-type products every time the level lowers due to dispensing.

As a whole, conventional machines are therefore unappealing for consumers and significantly limit their demand for the product.

SUMMARY OF THE INVENTION

The aim of the present invention is to solve the above-noted problems of the prior art by providing a highly hygienic machine for producing and dispensing still and carbonated crushed-ice or slush-type products which allows to avoid the formation of unaesthetic level lines in the containment tank, allows rapid and easy cleaning of said tank and assuredly isolates the contents of the tank from any external manipulation.

This aim and other objects are achieved by a highly hygienic machine for producing and dispensing still and carbonated crushed-ice or slush-type products, comprising a base for accommodating conventional operating elements above which at least one tank for containing the slush-type products ready for consumption is installed, said tank being provided with a dispenser tap, characterized in that said tank is hermetic and can be hermetically connected to pressurization means and to pre-cooling elements for volumes of still or carbonated beverages.

BRIEF DESCRIPTION OF THE DRAWING

Further characteristics and advantages will become better apparent from the following detailed description of a preferred embodiment of a highly hygienic machine for producing and dispensing still and carbonated slush-type products, illustrated only by way of non-limitative example in the accompanying drawing, wherein the only figure is a schematic view of the present invention.

DESCRIPTION OF THE PREFERRED EMBODIMENTS

Figure 1:
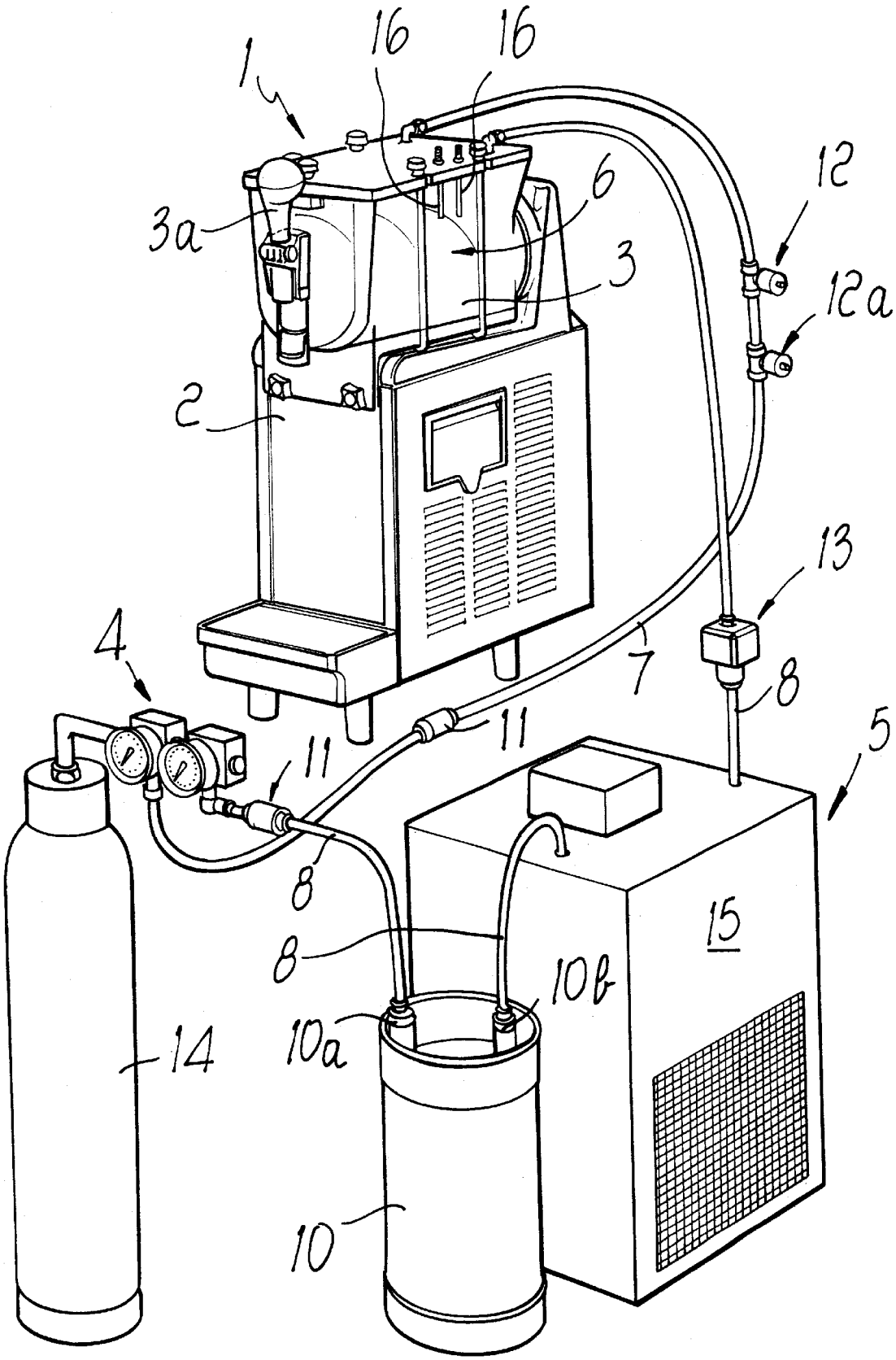

With reference to the figure, the reference numeral 1 designates a highly hygienic machine for producing and dispensing still and carbonated slushtype products.

The machine 1 is essentially composed of a base 2 which accommodates the conventional operating elements and a refrigeration system, not shown in the drawings, above which at least one tank 3 is installed for containing slush-type products ready for consumption; this tank is hermetic and hermetically connectable to pressurization means 4 and to pre-cooling elements 5 for still or carbonated beverages.

The tank 3 is also associable, in a modular fashion, with other identical tanks in order to compose batteries for individual machines 1 for making and dispensing slush-type products in a plurality of flavors, and can further be inspected visually from outside, since it can preferably be produced using transparent material such as glass or plastics for food use.

Means 6 for constantly measuring the level of the slush-type product are installed inside the tank 3, and the tank is connected to the pressurization means 4 and to the pre-cooling elements 5 for the still or carbonated beverages by means of at least two hermetic and separate pipes 7 and 8 which are mutually circuitally parallel; a first one of these pipes, specifically the one designated by the reference numeral 7, directly connects the pressurization means 4 to the hermetic tank 3, while the second pipe 8 mutually connects, in a serial arrangement, the pressurization means 4 and the pre-cooling elements 5 and the pre-cooling elements to the hermetic tank 3.

Upstream of the pre-cooling elements 5 there is at least one reservoir 10 for containing the still or carbonated beverages; this reservoir also is hermetic and is provided with at least one pair of ports, respectively an inlet port 10*a* and an outlet port 10*b* for the second pipe 8.

One-way valve means 11 are fitted on said first and second pipes 7 and 8; moreover, at least on the first pipe 7 there is a control valve means 12 and a safety vent valve means 12*a*, preferably of the type with two intervention thresholds which can be preset to mutually different maximum values.

In turn, a valve means 13 is fitted on the second pipe 8, downstream of the pre-cooling elements 5, and repeatedly acts as a dispenser of volumes of still or carbonated beverages; its activation is controlled by each request of said means 6 for detecting the level of slush-type product in the tank 3.

In the preferred embodiment of the machine 1, the pressurization means 4 are constituted by at least one gas, particularly carbon dioxide, which is conventionally contained in a cylinder 14 from which both the first pipe 7 and the second pipe 8 extend.

Nonetheless, these pressurization means 4 can also be constituted, in an alternative embodiment of the machine 1 not shown for the sake of simplicity and only as regards their propulsive function, by at least one pump which is connected, however, only to the inlet of the second pipe 8.

The presence of the pressurization means 4, however, is necessary because they maintain a constant pressure in the hermetic tank 3.

The pre-cooling elements 5 are constituted by at least one refrigeration means 15 which is crossed by the second hermetic pipe 8 and is provided with a presettable thermostatic adjustment.

Finally, the means 6 for detecting the level of slush-type product are constituted by a pair of probes 16 for detecting a minimum level and a maximum level of slush-type product in the hermetic tank.

It is noted that in the above description the constructive aspects of the one-way valve means 11, of the control and safety vent valve means 12 and of the dispenser valve means 13 have not been specified in detail since they are of a type which is known to the skilled in the field.

The operation of the invention is as follows: when the machine 1 is activated, the two probes 16 activate the opening of the dispenser valve means 13 fitted on the second pipe 8, which allows the passage of a volume of still or carbonated beverage that arrives from the reservoir 10 and is pre-cooled by passing through the refrigeration means 15.

The carbon dioxide that is contained in the cylinder 14 keeps both the inside of the hermetic tank 3 and the reservoir 10 under pressure.

The conventional means contained in the base 2 of the machine 1 convert the volume of beverage that has entered the tank 3 into the icy mass that actually constitutes the slush-type product.

Each time an amount of the slush-type product is dispensed through the tap 3*a*, the drop in level is detected by the probes 16 which, once they have reached a presettable minimum value, actuate the reopening of the dispenser valve means 13, which restores the level to the preset value, keeping substantially constant the volume of slush-type product inside the hermetic tank 3.

The beverage that determines the flavor of the slush-type product reaches the tank, as mentioned; the beverage is propelled into the tank 3 through the pipe 8 under the action of the pressure supplied by the carbon dioxide dispensed by the cylinder 4. The tank 3 is fully hermetic and transparent and thanks to these particular characteristics it allows to maintain the carbonation of the beverage that has entered it although it passes from the liquid state to the semisolid state (slush) and to display externally the product contained therein, thus increasing the customer attraction factor.

On the first pipe 7, the safety vent valve means 12 intervene if the pressure of the carbon dioxide exceeds the maximum values that have been preset for the proper operation of the machine 1, venting part of it externally until safety conditions are reestablished.

The one-way valve means 11 prevent any reverse flow of gas and syrup inside the pipes 7 and 8.

The operation of the invention is similar for conventional slush-type products, i.e. non-carbonated ones, the only difference being that the carbon dioxide propels the still beverage into the tank 3.

In practice it has been observed that the above-described invention achieves the intended aim and objects, i.e. it allows to make and dispense slush-type products with maximum hygiene.

The invention thus conceived is susceptible of numerous modifications and variations, all of which are within the scope of the inventive concept; thus, for example, the still or carbonated beverage can also arrive directly from a conventional so-called "post-mix" system, by connection to the pipe 8.

All the details may further be replaced with other technically equivalent ones.

In practice, the materials employed, as well as the shapes and the dimensions, may be any according to requirements without thereby abandoning the scope of the protection of the appended claims.

The disclosures in Italian Patent Application No. M099AO00206 from which this application claims priority are incorporated herein by reference.

What is claimed is:

1. A highly hygienic machine for producing and dispensing still and carbonated crushed-ice or slush-type products, comprising a base for accommodating conventional operating elements above which at least one tank for containing the products is installed, said tank being provided with a dispenser tap, wherein said tank is pressurized, hermetic, and transparent and wherein the pressurization is sufficient to prevent reverse flow within the machine.

2. The machine according to claim 1, wherein said tank can be associated in a modular fashion with other identical tanks adapted to constitute batteries for individual machines for making and dispensing slush-type products in multiple flavors.

3. The machine according to claim 1, wherein said tank is transparent and can be visually inspected from outside.

4. The machine according to claim 1, wherein means for detecting the level of slush-type product inside said tank are provided.

5. The machine according to claim 1, wherein said tank is connected to said pressurization means and said pre-cooling elements for the still or carbonated beverages by means of separate hermetic pipes or to conventional mixing systems of "post-mix" units.

6. The machine according to claim 5, wherein said hermetic pipes are at least two and are mutually parallel, a first pipe for direct connection between said pressurization means and said hermetic tank and a second pipe for connection between said pressurization means and said pre-cooling means and between said pre-cooling means and said hermetic tank.

7. The machine according to claim 6, wherein upstream of said pre-cooling elements there is at least one hermetic reservoir for containing the still or carbonated beverages which has at least one pair of ports, respectively for the inlet and outlet of said second pipe.

8. The machine according to claim 6, wherein one-way valve means are installed on said first and second pipes.

9. The machine according to claim 8, wherein a control and safety vent valve means is fitted on said first pipe.

10. The machine according to claim 9, wherein said safety vent valve means is of the type with two intervention thresholds which can be preset to mutually different maximum values.

11. The machine according to claim 8, wherein a valve means for repeatedly dispensing volumes of still or carbonated beverages is installed on said second pipe, downstream of said pre-cooling elements, and is controlled by said means for detecting the level of slush-type product in said tank.

12. The machine according to claim 6, wherein said pressurization means are constituted by at least one gas such as carbon dioxide, contained in a conventional cylinder from which said first and second pipes branch out.

13. The machine according to claim 6, wherein said pressurization means are constituted by at least one pump/pumping unit, connected to the inputs of said first and second pipes.

14. The machine according to claim 6, wherein said pre-cooling elements are constituted by at least one refrigeration means which is crossed by said second hermetic pipe and is provided with a presettable thermostatic adjustment.

15. The machine according to claim 4, wherein said means for detecting the level of slush are constituted by two pairs of probes for detecting a minimum level and a maximum level of slush in said hermetic tank.

16. The machine according to claim 9, wherein said control valve means is constituted by at least one pressure-controlled switch installed on said first pipe.

* * * * *